US005400570A

United States Patent [19]

Bennett

[11] Patent Number: 5,400,570

[45] Date of Patent: Mar. 28, 1995

[54] METHOD AND APPARATUS FOR HEAT SHRINKING FILM AROUND A PRODUCT

[76] Inventor: Charles J. Bennett, P.O. Box 160, Oakboro, N.C. 28129

[21] Appl. No.: 62,126

[22] Filed: May 17, 1993

[51] Int. Cl.[6] ..... B65B 53/04; B65B 53/06

[52] U.S. Cl. ..... 53/442; 53/557; 34/60; 34/68; 34/216; 34/217; 34/225

[58] Field of Search ..... 53/442, 557; 34/12, 34/225, 233, 60, 68, 216, 217, 218

[56] References Cited

U.S. PATENT DOCUMENTS

| | | | |
|---|---|---|---|
| 2,906,627 | 9/1959 | Payton et al. . | |
| 3,120,728 | 2/1964 | Snow et al. | 53/442 |
| 3,222,800 | 12/1965 | Siegel et al. . | |
| 3,309,835 | 3/1967 | Peppler . | |
| 3,312,811 | 4/1967 | Shanklin . | |
| 3,349,502 | 10/1967 | Kiefer . | |
| 3,399,506 | 9/1968 | Howe, Jr. . | |
| 3,616,546 | 11/1971 | Billingsley et al. . | |
| 3,673,703 | 7/1972 | Wieligmann . | |
| 3,678,244 | 7/1972 | Worline | 53/557 X |
| 3,727,324 | 4/1973 | Melgaard . | |
| 3,744,146 | 7/1973 | Nichols . | |
| 3,869,844 | 3/1975 | Edouard . | |
| 3,889,394 | 6/1975 | Fischer . | |
| 4,066,866 | 1/1978 | Fresnel . | |
| 4,738,082 | 4/1988 | Saitoh | 53/557 |
| 4,821,428 | 4/1989 | Good | 34/233 X |
| 5,062,217 | 11/1991 | Tolson . | |
| 5,193,290 | 3/1993 | Tolson . | |

FOREIGN PATENT DOCUMENTS

| | | | |
|---|---|---|---|
| 2119341 | 11/1983 | United Kingdom | 53/442 |
| 8912574 | 12/1989 | WIPO | 53/442 |

*Primary Examiner*—Linda B. Johnson

*Attorney, Agent, or Firm*—Shefte, Pinckney & Sawyer

[57] ABSTRACT

An apparatus for heat shrinking an envelope of heat shrinkable film into close conformity to a product enclosed within the film envelope includes a housing; a first assembly disposed within the housing for directed heated air to at least a first portion of the film envelope; a second assembly disposed with the housing and operable subsequent to the first assembly for directing heated water onto at least a second portion of the envelope, both causing the envelope to shrink into conformity with the product; an arrangement for drying the product after water has been applied thereto; and an arrangement for circulating the hot water into heat transfer relation with a moving stream of the hot air for enhanced water heating prior to its application to the product.

18 Claims, 1 Drawing Sheet

METHOD AND APPARATUS FOR HEAT SHRINKING FILM AROUND A PRODUCT

BACKGROUND OF THE INVENTION

The present invention relates generally to methods and apparatus for heat shrinking an envelope of heat shrinkable film into close conformity with a product and more particularly to a method and apparatus using hot air and hot water in combination as the shrinking medium to shrink the film.

It is well known to employ various flexible, heat shrinkable sheet materials for packaging products, including food products. These heat shrinkable materials provide an inexpensive, substantially airtight package which will prevent contamination of the product when properly heat sealed and which will maintain perishable items in a state of freshness for a relatively long period of time. In addition, these films enhance the appearance of the product and conform to the contours of the product due to their transparency and shrinking characteristics respectively. Typically, chicken pieces and other refrigerated meat items are packaged for sale to the public in heat shrinkable wrappers.

Heretofore, these packages were wrapped with heat shrinkable film with the film being caused to shrink in so-called "shrink-tunnels" wherein hot air is applied to the package, causing the film to shrink therearound. However, problems with this method have arisen when packaging cold food products since once the film contacts the cold food, shrinking stops even in the presence of hot moving air. The result is a package which may or may not be sealed properly and which presents an unsightly appearance.

Other methods of heat shrinking film around a product include subjecting the product package to immersion in a water bath or passage through a water curtain. This substantial application of water is enough to overcome the problem of the film ceasing to shrink when contacting the cold food product. However, a relatively large amount of energy is required to initially heat the water and maintain the necessary temperature to provide proper shrink wrapping of a product. It is therefore desirable to provide a heat shrinking apparatus which will more efficiently heat shrink wrappers around cold products.

SUMMARY OF THE INVENTION

It is accordingly an object of the present invention to provide a heat shrinking apparatus which solves the aforementioned problems by using hot air and hot water in combination as the film shrinking medium. More particularly, it is an object of the present invention to provide an apparatus for heat shrinking an envelope of heat shrinkable film around a chilled food product which uses hot water to cause shrinking of portions of the film envelope adjacent the chilled food product and uses hot air to cause the remainder of film shrinking. A further object is to improve efficiency of the heat shrinking apparatus by recirculating a portion of the hot water into the hot air stream for supplemental heating thereof.

Briefly summarized, the present invention basically provides an apparatus and method for heat shrinking an envelope of heat shrinkable film into close conformity to a product enclosed within the film envelope by subjecting at least a first portion of the film envelope to heated air from a first heated air directing assembly for causing that portion of the film envelope to shrink into conformity with an adjacent first portion of the product and by subjecting at least a second portion of the envelope to heated water from a second, heated water directing assembly for causing at least the second portion of the envelope to shrink into conformity with an adjacent second portion of the product. The first directing assembly is disposed at a first shrinking station and the second directing assembly is disposed at a second shrinking station and the apparatus further includes an assembly, preferably an endless conveyor, for conveying the package from the first shrinking station to the second shrinking station.

According to the present invention, the heated air is at a greater temperature than the heated water and an arrangement is included for circulating the heated water into heat transfer relation with the heated air for using the heated air to increase the temperature of the heated water prior to application thereof to the film envelope. It is preferred that the circulating arrangement includes a hot water coil in communication with the heated water supply reservoir and an apparatus for circulating heated water to the coil, the coil being arranged in heat transfer relation with the first directing assembly for flow of the heated air across the coil for the transfer of heat from the heated air to the heated water.

It is preferred that the heat shrink apparatus of the present invention further includes a third assembly disposed within the housing and operable subsequent to the second assembly for directing heated air onto the envelope for drying the envelope after the application thereto of heated water by the second directing assembly.

Preferably the first directing assembly includes an arrangement disposed beneath the conveyor for directing the heated air against a bottom portion of the envelope to shrink the envelope bottom portion into conformity with an underside of the product and the second directing assembly includes an arrangement disposed above the conveyor for directing the heated water against a top portion of the envelope to shrink the envelope top portion into conformity with a top side of the product.

According to the preferred embodiment of the present invention, the product is a chilled food product of a non-uniform shape supported in an open top tray and the first directing assembly is disposed for directing the heated air against a bottom portion of the envelope adjacent the tray and the second directing assembly is disposed for directing the heated water against a top portion of the envelope adjacent the chilled food product. Here, the second directing assembly is operable subsequently to the first directing assembly.

It is further preferred that the second directing assembly include a spray arrangement for directing a spray of water at the product. The spray arrangement is controlled to direct the spray of heated water in an amount just sufficient to complete the shrinkage of the film envelope into close conformity with the product.

DETAILED DESCRIPTION OF THE PREFERRED EMBODIMENT

Figure 1:
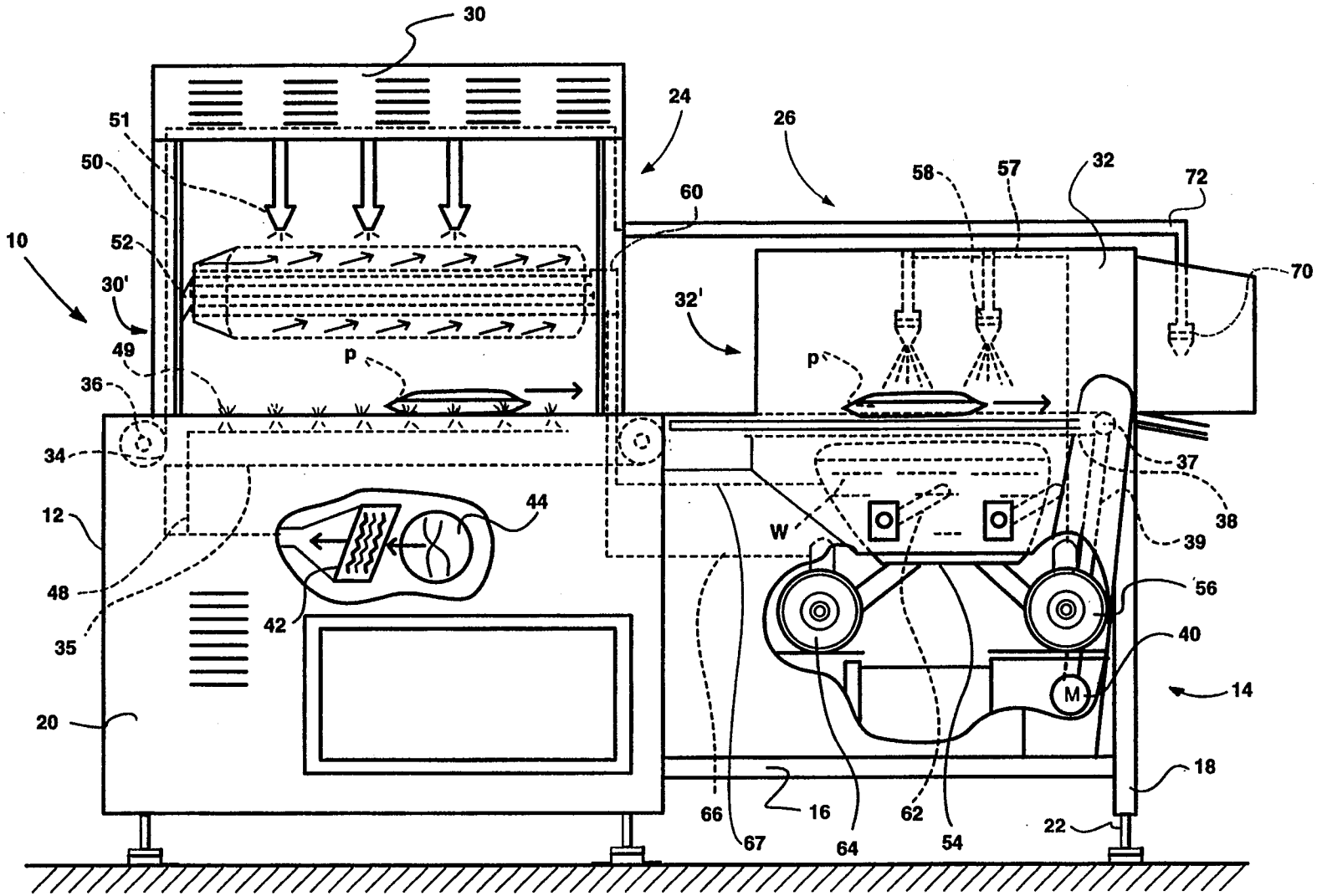
FIG. 1 is a side-view diagrammatic representation of an apparatus for heat shrinking an envelope of heat shrinkable film into close conformity to a product enclosed within the film envelope according to the preferred embodiment of the present invention.

Referring now to FIG. 1, an apparatus for heat shrinking an envelope of heat shrinkable film into close conformity to a product enclosed within the film envelope is shown generally at 10. In the preferred embodiment of the present invention, the apparatus 10 is particularly suited to shrinking film around a chilled food product disposed in an open-topped tray. However, those persons skilled in the art will recognize that the present invention is not limited to use with food products.

The apparatus basically includes a housing 12 configured for an upright floor standing disposition. The housing 12 primarily consists of a frame 14 having a plurality of spaced apart, upright frame members 18 interconnected by cross members 16 which extend laterally between the upright frame members 18 forming a generally cage-like structure. A plurality of foot members 22 project outwardly from the lowermost portions of the upright frame members 18 providing a surface upon which the apparatus 10 can rest. The frame 14 has a plurality of generally rectangular, planar wall panels 20 covering the skeletal frame 14, the panels 20 being attached to the frame members 16,18, thereby enclosing the structure and forming the housing 12.

The frame 12 is basically divided into two operationally defined portions, a hot air treatment portion 24 and a hot water treatment portion 26, each portion 24,26 comprising approximately one half of the entire apparatus 10 and being arranged in a side-by-side relation. The housing 12 includes rectangular hood 30 defining a first tunnel 30' through which a product may pass for hot air shrink wrap treatment. A first heating station is defined by the hot air treatment portion 24 of the apparatus 10.

A second heating station is defined by the hot water treatment portion 26 of the housing 12 which includes a second generally rectangular hood 32 defining a second tunnel 32' aligned with the first tunnel 30' through which a product may pass for hot water treatment.

In order to transport the product to be shrink wrapped through the apparatus 10, a pair of conveyors are provided. The first conveyor 34, which is shown in broken lines in FIG. 1, extends lengthwise through the hot air treatment portion 24 of the housing 12 and is disposed immediately below the first tunnel 30'. The first conveyor 34 is preferably in the form of an endless open-work link or belt loop member 35 trained around two guide rollers 36, one of which is driven, the loop member 35 thereby having sufficient openings formed therein over its length and width for generally unrestricted flow of air therethrough. Alternatively, the conveyor 34 may be formed by a series of spaced rollers providing openings through which hot air may pass, as will be described in greater detail hereinafter. The second conveyor 38 extends lengthwise through the hot water treatment portion 26 of the housing 12 and is disposed immediately below the second tunnel 32'. The second conveyor 38 is disposed adjacent the end of the first conveyor 34 so that a product traveling on the first conveyor 34 will be picked up and transported by the second conveyor 38 when it reaches the junction of the two conveyors 34,38. The second conveyor 38 is configured similarly to the first conveyor 34 and is driven by a drive belt or chain 39 which extends between the drive roller 37 and a drive motor 40 which is mounted to the frame 14.

In order to effect efficient heat shrinkage of the heat shrinkable film surrounding a product, a two stage heat shrinking process is provided by the apparatus 10 of the present invention. Specifically, the hot air treatment portion 24 contains an arrangement for directing heated air to at least a portion of the film envelope and comprises a first shrinking station. The hot water treatment portion 26 contains an assembly for directing hot water to at least the remaining portion of the film envelope and comprises a second shrinking station.

With regard to the hot air treatment portion 24, a heater 42 is disposed within the housing 12 across which air is forced by a fan 44 which is also disposed within the housing 12. The heater 42 is typically a fifteen kilowatt electric heater providing heated air at a temperature of approximately 300° F. The heated air is routed to a variety of locations for a variety of purposes. Hot air is routed through a conduit or ductwork system 48 disposed within the lower portion of the hot air treatment portion 24 of the housing 12, shown schematically by broken lines in FIG. 1, to a plurality of nozzles 49 which are disposed underneath the upper run of the first conveyor 34 for application of hot air to the underside of the product as the first conveyor 34 carries it over the nozzles 49. As previously stated, openings are formed in the first conveyor 34 for the passage of air therethrough. Hot air is also routed through another conduit or ductwork system 50 disposed within the upper portion of the hood 30 of the hot air treatment portion 24 of the housing 12, also shown schematically by broken lines in FIG. 1, to a plurality of nozzles 51 which are suspended from the upper portion of the hot air hood 30 to direct air downwardly to the top of the package P as it passes through the hot air treatment portion 24. A portion of the hot air is diverted from the upper ductwork 50 through a branch duct 72 for direction to a drying nozzle 70 which will be explained in greater detail hereinafter. Finally, hot air is routed to the side portions of the hot air hood 30 through a conduit or ductwork system 52 disposed along the two laterally opposed sides of the hot air hood 30 which directs hot air to the sides of the package P as it passes through the hot air hood 30 as well as directing air across a hot water heat exchanger 60 as shown in arrows in FIG. 1, as will also be explained in greater detail hereinafter. By the above, it can be seen that hot air is directed to the package P from all four sides of the rectangular hot air hood 30 as the package P passes therethrough.

Turning now to the hot water treatment portion 26, a water reservoir 54 is disposed within the hot water portion 26 of the housing 12 beneath the conveyor 38 providing a water supply and a basin for recovery of water W applied to the package P. An application pump 56 is mounted to the frame 14 beneath the reservoir 54 to deliver water through piping 57 from the reservoir 54 to a plurality of nozzles 58 which are disposed within the hot water hood 32 and directed generally downwardly to apply hot water to the upper portions of the package P as it passes through the hot water hood 32. Conventional electric heating coils 62 are disposed within the reservoir 54 to heat the water to approximately 180° F.

As the product P emerges from the hot water hood 32 it will still be wet from application of hot water thereto. In that regard and as previously stated, an assembly for drying the packages is provided which includes a drying nozzle 70 disposed at the outlet of the hot water hood 32 and communicated with the air heater 42 through the ductwork 72 branching from the upper ductwork 50. The drying nozzle 70 emits a downwardly directed stream of hot air for drying the package P after the water is applied thereto.

Enhanced efficiency of the shrink wrapping operation is provided by recirculating a portion of the water W contained within the reservoir 54 into heat transfer relation with the hot air. For this purpose, recirculation pump 64 is disposed underneath the reservoir 54, adjacent the application pump 56. As previously mentioned, a heat exchanger 60 is disposed within the hot air hood 30 through which the hot water is circulated into heat transfer relation with the hot air. The heat exchanger 60, depicted schematically in FIG. 1, is a conventional generally sinuous coil of piping for circulating water therethrough. Substantially identical heat exchangers 60 are disposed on either lateral side of the hot air hood 30, however, only one is shown in FIG. 1 for clarity. The recirculation pump 64 communicates with the heat exchanger 60 through conventional piping 66. A return pipe 67 returns water heated in the heat exchanger 60 to the reservoir 54. As previously mentioned, the intermediate ductwork 52 directs hot air across the coils of the heat exchanger 60 for heat transfer, as shown by arrows in FIG. 1. Water circulated from the reservoir 54 by the recirculation pump 64 into the heat exchanger 60 is returned at an elevated temperature to the reservoir 54 for application to the package P through the aforesaid hot water directing assembly. Typically, hot air at 300° F will increase the water temperature from 180° F. to 200° F. for application to the package P. In this manner, hot air is used to elevate the temperature of the hot water, thereby eliminating the need for large capacity steam or electric hot water heaters and enhancing the efficiency of the heat shrinking process.

Operation of the apparatus of the present invention is basically as follows. According to the method of the present invention, an envelope of heat shrinkable film may be caused to shrink into close conformity to a product by placing the product on the first conveyor 34 which causes the product P to be transported through the hot air hood 30 wherein it is subjected to hot air from the lower hot air nozzles 49, the upper hot air nozzles 51 and air exiting the heat exchanger 60 which is at a slightly reduced temperature due to the hot air giving up some of its energy to the water passing through the coils thereof. This application of hot air causes the shrink wrap film to shrink into generally close conformity with the configuration of the package P. However, when the upper portion of the shrink wrap film contacts the cold food product contained within the package P, shrinking stops and the package P retains a rough, unfinished appearance as it exits the hot air hood 30, still being transported on the first conveyor 34.

The first conveyor 34 then deposits the package P onto the second conveyor 38 for transport through the hot water hood 32. Within the hot water hood 32 the aforesaid water nozzles 58 discharge onto the package P a stream of hot water on the top and sides thereof. This hot water application causes the heat shrink film to complete the heat shrinking process, even in the region of the cold food product due to the direct, prolonged contact between the hot water and the film. Water that is applied to the package P drains off and reenters the reservoir 54 through the openings in the second conveyor 38.

From the reservoir 54 the hot water is circulated by the recirculating pump 64 through the heat exchanger 60 where the aforesaid water temperature elevation process is performed with the resulting hotter water returning to the reservoir 54.

As the package emerges from the hot water hood 32 it is still wet from the application of hot water thereto. Therefore, at the end of the process, hot air is directed to the package P through the drying nozzle 70 which effectively dries the package P, completing the shrink wrap process.

By the above, a method and apparatus for heat shrinking an envelope of heat shrinkable film into close conformity to a product enclosed within the envelope provides a final packaged product of enhanced appearance and does so in a simple and efficient process.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. Apparatus for heat shrinking an envelope of heat shrinkable film into close conformity to a product enclosed within the film envelope, said apparatus comprising, in combination, first means for heating air and directing heated air onto at least a first portion of the film envelope for causing that portion of the envelope to shrink into conformity with an adjacent first portion of the product, second means for heating water and directing heated water onto at least a second portion of the envelope for causing at least the second portion of the envelope to shrink into conformity with an adjacent second portion of the product, wherein said heated air is at a greater temperature than said heated water; and means for circulating said heated water into heat transfer relation with said heated air to elevate the temperature of the heated water.

2. A heat shrinking apparatus according to claim 1, wherein said second directing means includes a heated water supply, and said circulating means includes a hot water coil in communication with said heated water supply for circulating heated water through said coil, said coil being arranged in heat transfer relation with said first directing means for flow of said air across said coil for exchange of heat between said heated air and said heated water.

3. A heat shrinking apparatus according to claim 1 and further comprising third means operable subsequent to said second directing means for directing heated air onto said envelope for drying said envelope after the application thereto of heated water by said second directing means.

4. A heat shrinking apparatus according to claim 1 and further comprising a first shrinking station having said first directing means disposed thereat, a second shrinking station having said second directing means disposed thereat, and means for conveying the product from said first shrinking station to said second shrinking station.

5. A heat shrinking apparatus according to claim 4, wherein said conveying means includes an endless conveyor.

6. A heat shrinking apparatus according to claim 5, wherein said first directing means includes means disposed beneath said conveyor for directing said heated air against a bottom portion of the envelope to shrink said envelope bottom portion into conformity with an underside of the product and said second directing means includes means disposed above said conveyor for directing said heated water against a top portion of the envelope to shrink said envelope top portion into conformity with a top side of the product.

7. A heat shrinking apparatus according to claim 1, wherein the product is a chilled food product of a non-uniform shape supported in an open-topped tray, said first directing means is disposed for directing said heated air against a bottom portion of the envelope adjacent said tray and said second directing means is disposed for directing said heated water against a top portion of the envelope adjacent the chilled food product.

8. A heat shrinking apparatus according to claim 7, wherein said second directing means is operable subsequently to said first directing means.

9. A heat shrinking apparatus according to claim 1, wherein said second directing means is operable subsequently to said first directing means.

10. A heat shrinking apparatus according to claim 1, wherein said second directing means includes spray means for directing a spray of heated water at the product.

11. A heat shrinking apparatus according to claim 10, wherein said spray means is controlled to direct said spray of heated water in an amount just sufficient to complete the shrinkage of the film envelope into close conformity with the product.

12. A method for heat shrinking an envelope of heat shrinkable film into close conformity to a product enclosed within the film envelope, said method comprising the steps of:

heating air and directing heated air onto at least a first portion of the film envelope for causing that portion of the envelope to shrink into conformity with an adjacent first portion of the product;

heating water and directing heated water onto at least a second portion of the envelope for causing at least the second portion of the envelope to shrink into conformity with an adjacent second portion of the product, wherein said heated air is at a greater temperature than said heated water; and circulating said heated water into heat transfer relation with said heated air and thereby elevating the temperature of the heated water.

13. A method for heat shrinking an envelope of heat shrinkable film according to claim 12 and further comprising the step of directing heated air onto said envelope for drying said envelope subsequent to the application of heated water to said envelope.

14. A method for heat shrinking an envelope of heat shrinkable film according to claim 12, wherein said step of directing heated air occurs at a first location and said step of directing heated water occurs at a second location, said method further comprising the step of conveying the package from said first location to said second location upon completion of said step of directing heated air to said package.

15. A method for heat shrinking an envelope of heat shrinkable film according to claim 12, wherein the step of directing heated air includes directing said heated air against a bottom portion of the envelope to shrink said envelope bottom portion into conformity with an underside of the product and the step of directing heated water includes directing said heated water against a top portion of the envelope to shrink said envelope top portion into conformity with the top side of the product.

16. A method for heat shrinking an envelope of heat shrinkable film according to claim 15, wherein the product includes a chilled food product of a non-uniform shape supported in an open-topped tray.

17. A method for heat shrinking an envelope of heat shrinkable film according to claim 12, wherein the step of directing heated water includes directing a spray of heated water at the product.

18. A method for heat shrinking an envelope of heat shrinkable film according to claim 17, wherein the step of directing a spray of heated water includes controlling the spray of heated water to apply said heated water in an amount just sufficient to complete the shrinkage of the film envelope into close conformity with the product.

* * * * *